US010476162B2

(12) United States Patent
Yoon et al.

(10) Patent No.: US 10,476,162 B2
(45) Date of Patent: Nov. 12, 2019

(54) WIRELESS COMMUNICATION ANTENNA AND MOBILE DEVICE INCLUDING THE SAME

(71) Applicant: WITS Co., Ltd., Yongin-si, Gyeonggi-do (KR)

(72) Inventors: Hyo Jung Yoon, Suwon-si (KR); Hee Seung Kim, Suwon-si (KR); Jae Sun Won, Suwon-si (KR); Jae Hyuk Jang, Suwon-si (KR); Chang Hee Lee, Suwon-si (KR); Gie Hyoun Kweon, Suwon-si (KR); Jong Lae Kim, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 95 days.

(21) Appl. No.: 15/644,875

(22) Filed: Jul. 10, 2017

(65) Prior Publication Data

US 2018/0083359 A1 Mar. 22, 2018

(30) Foreign Application Priority Data

Sep. 21, 2016 (KR) ..... 10-2016-0120665
Dec. 1, 2016 (KR) ..... 10-2016-0163072

(51) Int. Cl.
*H01Q 7/08* (2006.01)
*H01Q 1/24* (2006.01)

(52) U.S. Cl.
CPC ..... *H01Q 7/08* (2013.01); *H01Q 1/243* (2013.01)

(58) Field of Classification Search
CPC ..... H01Q 7/08; H01Q 1/243
See application file for complete search history.

(56) References Cited

U.S. PATENT DOCUMENTS

2013/0206845 A1 8/2013 Koujima et al.
2013/0307746 A1 11/2013 Nakano et al.
2014/0043196 A1 2/2014 Gouchi et al.
2016/0294058 A1* 10/2016 Tunnell ..... G06Q 20/3278

FOREIGN PATENT DOCUMENTS

JP 2014-161003 A 9/2014
KR 10-1470341 B1 12/2013
KR 10-2013-0142991 A 12/2014

* cited by examiner

*Primary Examiner* — Graham P Smith
(74) *Attorney, Agent, or Firm* — Harness, Dickey & Pierce, P.L.C.

(57) ABSTRACT

A wireless communication antenna comprises a magnetic body and coil portions. The coil portions have a solenoid shape formed around the magnetic body defining a core. The coil portions are spaced apart from each other and connected to each other in series. Magnetic fields radiated by the coil portions overlap each other and each of the coil portions comprises: a first wiring portion disposed on a first surface of the magnetic body; a second wiring portion disposed on a second surface of the magnetic body; and conductive vias interconnecting the first wiring portion and the second wiring portion.

22 Claims, 6 Drawing Sheets

I - I'

| Y\X | -4 | -3 | -2 | -1 | 0 | 1 | 2 | 3 | 4 |
|---|---|---|---|---|---|---|---|---|---|
| 8 | X | X | X | X | X | X | X | X | X |
| 7 | X | X | X | X | X | X | X | X | X |
| 6 | X | X | X | X | X | X | X | X | X |
| 5 | X | O | O | O | O | X | X | X | X |
| 4 | O | O | O | O | O | O | O | X | X |
| 3 | O | O | O | O | O | O | O | O | X |
| 2 | O | O | O | O | O | O | O | O | X |
| 1 | O | O | O | O | O | O | O | O | X |
| 0 | O | O | O | O | O | O | O | O | O |
| -1 | O | O | O | O | O | O | O | O | X |
| -2 | O | O | O | O | O | O | O | O | X |
| -3 | O | O | O | O | O | O | X | X | X |
| -4 | X | X | X | X | X | X | X | X | X |
| -5 | X | X | X | X | X | X | X | X | X |
| -6 | X | O | O | O | X | X | X | X | X |
| -7 | X | O | O | O | O | X | X | X | X |
| -8 | X | O | O | O | O | X | X | X | X |

| Y\X → | −4 | −3 | −2 | −1 | 0 | 1 | 2 | 3 | 4 |
|---|---|---|---|---|---|---|---|---|---|
| 8 | × | × | × | × | × | × | × | × | × |
| 7 | × | × | × | × | × | × | × | × | × |
| 6 | × | × | × | × | × | × | × | × | × |
| 5 | ○ | ○ | ○ | ○ | ○ | × | × | × | × |
| 4 | ○ | ○ | ○ | ○ | ○ | ○ | ○ | × | × |
| 3 | ○ | ○ | ○ | ○ | ○ | ○ | ○ | ○ | × |
| 2 | ○ | ○ | ○ | ○ | ○ | ○ | ○ | ○ | × |
| 1 | ○ | ○ | ○ | ○ | ○ | ○ | ○ | ○ | ○ |
| 0 | ○ | ○ | ○ | ○ | ○ | ○ | ○ | ○ | ○ |
| −1 | ○ | ○ | ○ | ○ | ○ | ○ | ○ | ○ | ○ |
| −2 | ○ | ○ | ○ | ○ | ○ | ○ | ○ | ○ | × |
| −3 | ○ | ○ | ○ | ○ | ○ | ○ | ○ | × | × |
| −4 | × | × | × | × | × | × | × | × | × |
| −5 | × | × | × | × | × | × | × | × | × |
| −6 | × | ○ | ○ | ○ | ○ | × | × | × | × |
| −7 | × | ○ | ○ | ○ | ○ | × | × | × | × |
| −8 | × | ○ | ○ | ○ | ○ | × | × | × | × |

| Y\X → | -4 | -3 | -2 | -1 | 0 | 1 | 2 | 3 | 4 |
|---|---|---|---|---|---|---|---|---|---|
| 8 | X | X | X | X | X | X | X | X | X |
| 7 | X | X | X | X | X | X | X | X | X |
| 6 | X | X | X | X | X | X | X | X | X |
| 5 | O | O | O | O | O | O | X | X | X |
| 4 | O | O | O | O | O | O | O | X | X |
| 3 | O | O | O | O | O | O | O | O | X |
| 2 | O | O | O | O | O | O | O | O | O |
| 1 | O | O | O | O | O | O | O | O | O |
| 0 | O | O | O | O | O | O | O | O | O |
| -1 | O | O | O | O | O | O | O | O | O |
| -2 | O | O | O | O | O | O | O | O | X |
| -3 | O | O | O | O | O | O | O | O | X |
| -4 | X | X | O | O | O | X | X | X | X |
| -5 | X | X | X | X | X | X | X | X | X |
| -6 | X | O | O | O | O | X | X | X | X |
| -7 | O | O | O | O | O | O | X | X | X |
| -8 | O | O | O | O | O | O | X | X | X |

WIRELESS COMMUNICATION ANTENNA AND MOBILE DEVICE INCLUDING THE SAME

CROSS-REFERENCE TO RELATED APPLICATIONS

This application claims the benefit under 35 U.S.C. § 119(a) of Korean Patent Application Nos. 10-2016-0120665, filed on Sep. 21, 2016 and 10-2016-0163072, filed on Dec. 1, 2016 in the Korean Intellectual Property Office, the entire disclosure of which is incorporated herein by reference for all purposes.

BACKGROUND

1. Field

The following description relates to a wireless communication antenna and a mobile device including the same.

2. Description of Related Art

Wireless communications commonly have various applications. In particular, a wireless communication antenna formed of a coil may be used in various mobile devices when authorizing transactions, e.g., electronic payments at point of sale terminals.

In a mobile device, a wireless communication antenna formed of a spiral coil attached to a cover of the mobile device has recently been adopted.

However, wireless communication antennas adopted in wearable devices should reliably transmit and receive data while meeting a user's expectation for RF radiation direction and range.

Furthermore, as metal cases are employed in mobile devices, various types of wireless communication antennas, meeting the requirements of a radiation direction and a radiation range, have been researched.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a wireless communication antenna comprises a magnetic body and coil portions. The coil portions have a solenoid shape formed around the magnetic body defining a core. The coil portions are spaced apart from each other and connected to each other in series. Magnetic fields radiated by the coil portions overlap each other and each of the coil portions comprises: a first wiring portion disposed on a first surface of the magnetic body; a second wiring portion disposed on a second surface of the magnetic body; and conductive vias interconnecting the first wiring portion and the second wiring portion.

The coil portions may radiate the magnetic fields through a region between the coil portions, of the magnetic body.

The magnetic body may be formed by stacking thin plate magnetic layers, and the magnetic layer is formed of a soft magnetic alloy material.

The first wiring portion and the second wiring portion may comprise conductive patterns disposed on a thin film substrate, respectively.

The conductive vias may be formed through a resin layer disposed on an external portion of the magnetic body.

The coil portions may comprise three coil portions, and magnetic fields radiated from two regions between the three coil portions overlap each other.

In another general aspect, a mobile device comprises a wireless communication antenna comprising coil portions each spaced apart from the other. The coil portions have a solenoid shape and a magnetic body as a core. A cover having at least one slit covers the wireless communication antenna. The wireless communication antenna is disposed such that a portion of a magnetic field generated by the wireless communication antenna passes through the at least one slit.

The wireless communication antenna may allow each of the coil portions to radiate magnetic field through a region between the coil portions of the magnetic body.

The magnetic body may be formed by stacking thin plate magnetic layers and the magnetic layer is formed of a soft magnetic alloy material.

Each of the coil portions may comprise a first wiring portion disposed on a first surface of the magnetic body; a second wiring portion disposed on a second surface of the magnetic body; and conductive vias interconnecting the first wiring portion and the second wiring portion.

The first wiring portion and the second wiring portion may each comprise conductive patterns disposed on a thin film substrate.

The conductive vias may be formed through a resin layer disposed on an external portion of the magnetic body.

The cover may comprise a first slit and a second slit, and the wireless communication antenna may be disposed on an internal portion of the cover between the first slit and the second slit.

The cover may be formed of a metallic material, and the at least one slit may be filled with a non-metallic material.

The wireless communication antenna may radiate a magnetic pulse including magnetic stripe data.

The wireless communication antenna may be disposed such that a wound shaft of the coil portions is perpendicular to the at least one slit.

In another general aspect, a mobile device comprises an antenna formed around a magnetic body, the antenna has coil portions each spaced apart and connected to the other; each of the coil portions is formed on a film substrate; and a metallic cover disposed over the antenna, the metallic cover having slits. The coil portions of the antenna each radiate magnetic fields and the magnetic fields of each of the coil portions overlap to radiate a magnetic pulse including magnetic stripe data.

The magnetic pulse may radiate through the slits.

Each of the coil portions may be connected through conductive vias.

The conductive vias may be formed through a resin layer disposed on an external portion of the magnetic body.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
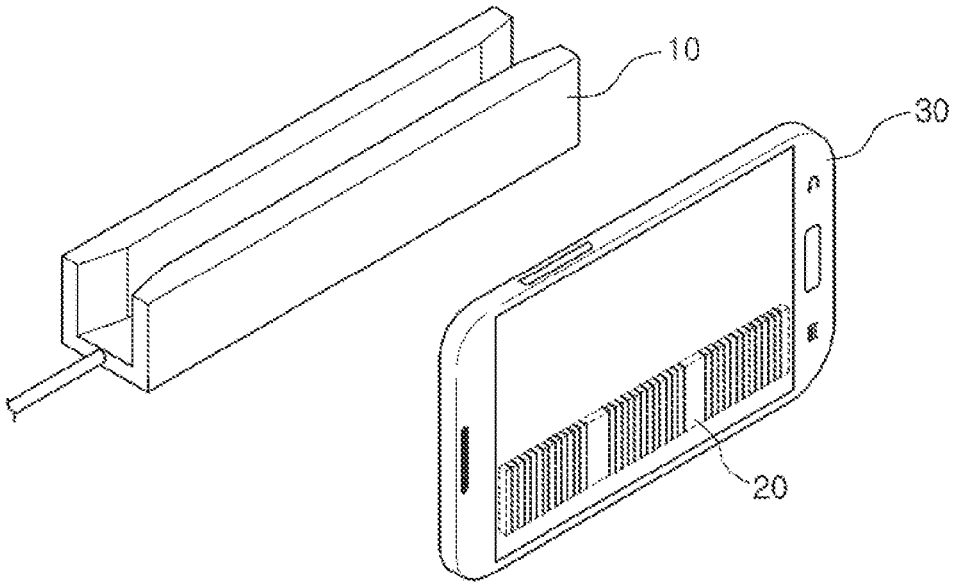
FIG. 1 is a perspective view illustrating an example in which a mobile device performs wireless communications.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a perspective view illustrating an example of a mobile device 30 used in wireless communication.

FIG. 1 depicts a system that may be used in a wireless transaction that includes a wireless signal receiver including a receiving coil and a magnetic card reader 10. According to an example, various wireless signal receivers, as a device including the receiving coil, may be used in addition to the magnetic card reader 10.

A wireless communication antenna 20 is included in the mobile device 30 to transmit data to the magnetic card reader 10. The mobile device 30 is configured to generate a magnetic field using the wireless communication antenna 20.

Further, the wireless communication antenna 20 operates as a transmitting coil, and is magnetically coupled to the wireless signal receiver including the receiving coil to wirelessly transmit data.

In one example, the wireless communication antenna 20 transmits data—e.g., card number data—desired to be transmitted to the magnetic card reader 10 by changing a direction of the magnetic field. The magnetic card reader 10 generates the card number data, using a change in a voltage generated across the receiving coil caused by the change in the direction of the magnetic field formed by the wireless communication antenna 20.

Hereinafter, magnetic coupling between a wireless communication antenna and a magnetic card reader, and an operation of the magnetic card reader will be described in more detail with reference to FIGS. 2 and 3.

Figure 2:
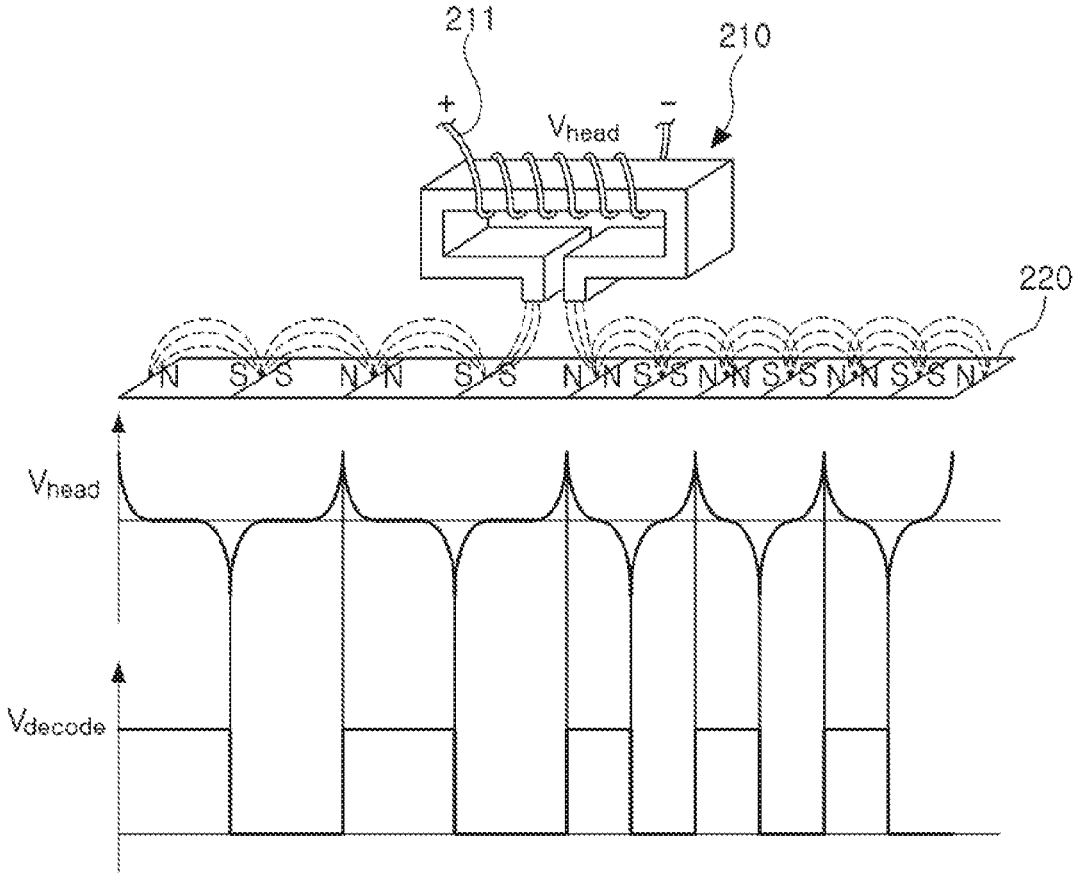
FIG. 2 is a view illustrating an example of a voltage across a magnetic head adjacent to a magnetic card.

FIG. 2 is a view illustrating an example of a voltage across a magnetic head adjacent to a magnetic card.

The magnetic card reader 10 (FIG. 1) includes a magnetic head 210 and an analog-to-digital converter (not illustrated). The magnetic head 210 generates a voltage by subtending magnetic flux. For example, the magnetic head 210 includes a receiving coil 211, and detects a voltage Vhead across the receiving coil 211 generated by the magnetic field.

When the receiving coil 211 experiences a change in the magnetic field, a voltage Vhead is generated across the receiving coil 211 by the magnetic flux.

The voltage Vhead generated across the receiving coil 211 is provided to the analog-to-digital converter, and the analog-to-digital converter generates a decoded signal Vdecode from the voltage Vhead across the receiving coil 211. The decoded signal Vdecode may be a digital voltage signal, and card information data may be generated from the decoded signal Vdecode.

The magnetic card has a magnetized magnetic stripe 220. As the magnetic head 210 is moved over the magnetic stripe 220, the voltage Vhead across the receiving coil 211 of the magnetic head 210 is generated by magnetic flux.

The voltage Vhead across the receiving coil 211 has a peak voltage that depends on polarities of the magnetic stripe 220. For example, in a case in which the same polarities are adjacent to each other, the voltage Vhead across the receiving coil 211 will have a peak voltage.

Further, the analog-to-digital converter generates the decoded signal Vdecode from the voltage Vhead across the receiving coil 211. For example, the analog-to-digital converter generates an edge signal whenever a peak voltage is detected and the edge signal is used to generate a decoded signal Vdecode.

The decoded signal Vdecode is a digital voltage signal from which digital data is decoded. For example, depending on lengths of a period of the decoded signal Vdecode, a '1' or '0' is implied. It can be seen from an illustrated example in FIG. 2 that the first period and the second period of the decoded signal Vdecode are each equal to twice the third period of the decoded signal Vdecode. Thus, in one example, the first period and the second period of the decoded signal Vdecode are decoded as '1', and the third period to the fifth period are decoded as '0'. Such a decoding method is illustrative, and it should be apparent to one of skill in the art, after gaining a full understanding of the disclosure, that various decoding technologies may be applied.

FIG. 2 illustrates an example in which a magnetic card reader performs decoding from a magnetized magnetic stripe. The magnetic head 210 generates the voltage Vhead across the receiving coil 111 from the magnetic field generated by the wireless communication antenna, as well as the magnetized magnetic stripe. The magnetic head 210 of the magnetic card reader is magnetically coupled to the transmitting coil of the wireless communication antenna to receive data—e.g., card number data.

Figure 3:
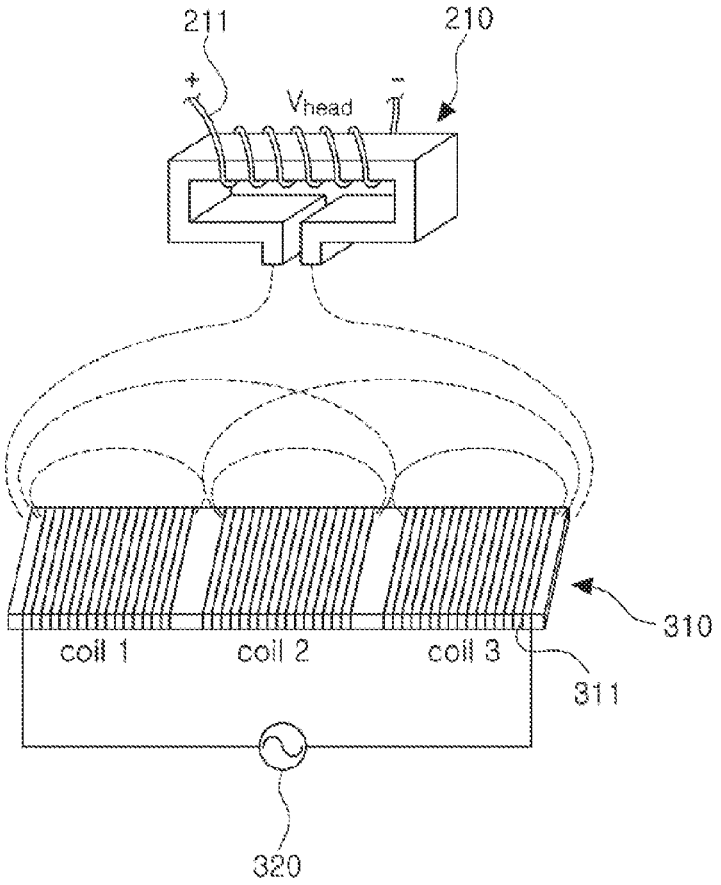
FIG. 3 is a view illustrating an example in which a magnetic head of a magnetic card reader is magnetically coupled to a wireless communication antenna.

FIG. 3 is a view illustrating an example in which the magnetic head 210 of the magnetic card reader is magnetically coupled to a wireless communication antenna 310.

The wireless communication antenna 310 receives a driving signal from a driving signal generator 320 to form a magnetic field. The magnetic head 210 is magnetically coupled to the magnetic field, formed by a transmitting coil 311, to receive data.

Further, the wireless communication antenna 20 includes a plurality of coil portions. Although FIG. 3 illustrates an example in which the wireless communication antenna 20 includes three coil portions, coil 1, coil 2, and coil 3, the number of coil portions included in the wireless communication antenna 20 may be changed.

The coil portions generate a plurality of magnetic field lines, respectively, and these magnetic field lines overlap each other to form a magnetic field formed of the plurality of loops.

The wireless communication antenna 20 forms a widespread magnetic field, using the coil portions, to improve magnetic coupling performance even when the position or angle of the receiving coil of the magnetic card reader 10 is changed.

Figure 4:
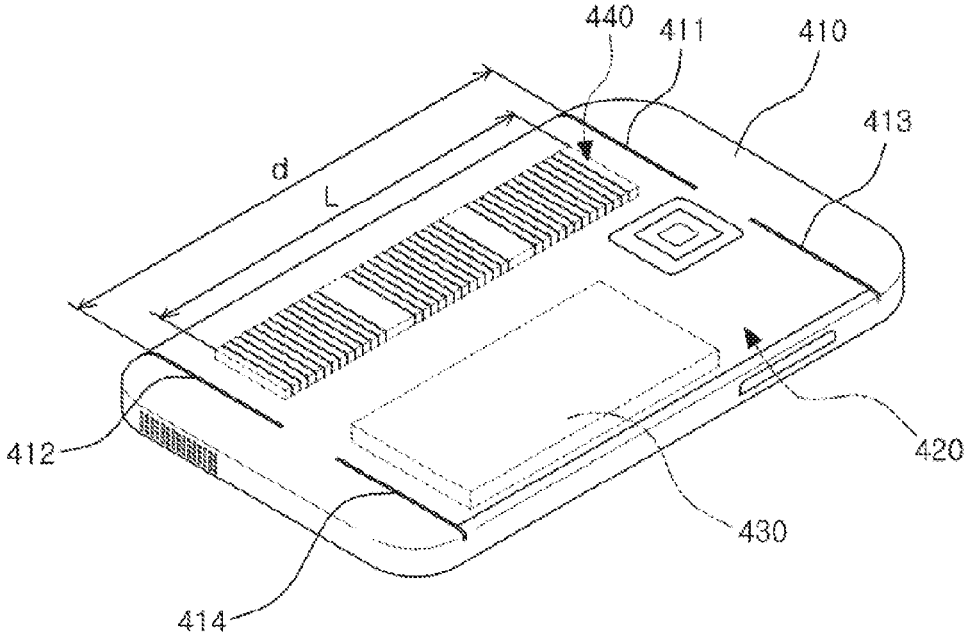
FIG. 4 is a perspective view of an example of a mobile device.

FIG. 4 is a perspective view of an example of a mobile device.

Referring to FIG. 4, the mobile device includes a cover 410, a display 420, a battery 430, and a wireless communication antenna 440.

The display 420 is disposed on a front or rear surface of the mobile device and used to visualize electronic signals to provide visual data to the user.

The cover 410 is integrally formed as a portion of a case of the mobile device, and is attached to or detached from the case. For example, when the display 420 is disposed on a front surface of the case, the cover 410 covers a rear surface opposing the front surface.

Further, the cover 410 is formed of a metallic material, and includes a plurality of first to fourth slits 411 to 414 used to increase RF radiation characteristics of the wireless communication antenna 440. Each of the first to fourth slits 411 to 414 is a gap formed in a portion of the cover 410, and is filled with a non-metallic material.

When these slits 411-414 are formed, the strength of the magnetic field formed externally of the mobile device by the wireless communication antenna 440 becomes stronger to further increase a coupling coefficient with a receiving coil—e.g., a magnetic head—or the like.

The battery 430 provides power for driving the mobile device. Further, the battery 430 may be charged using a wireless power charging scheme.

In one example, the wireless communication antenna 440 receives a driving signal from the driving signal generator 320 (FIG. 3) mounted on a main substrate to form a magnetic field. In other words, the wireless communication antenna 440 and the transmitting coil radiate a magnetic pulse. Further, the transmitting coil is magnetically coupled to the wireless signal receiver including the receiving coil, to wirelessly transmit data. Here, the data may be magnetic stripe data.

As illustrated in FIG. 4, the wireless communication antenna 440 has opposing ends disposed to be adjacent to the first to fourth slits 411 to 414, in order to improve the radiation characteristics of the wireless communication antenna 440. The wireless communication antenna 440 has a length corresponding to a distance between the first to fourth slits 411 to 414, such that the opposing ends of the wireless communication antenna 440 are adjacent to the first to fourth slits 411 to 414. In other words, the wireless communication antenna 440 is bounded by the first to fourth slits 411 to 414.

Further, the wireless communication antenna 440 includes a plurality of coil portions, having a solenoid shape and connected in series. The wireless communication antenna is disposed such that a wound shaft of the coil portions is perpendicular to the first to fourth slits 411 to 414.

For example, when the wireless communication antenna 440 is disposed between the first slit 411, disposed in an upper portion of the cover 410, and the second slit 412, disposed in a lower portion of the cover 410, and a distance d between the first and second slits 411 and 412 is 110 mm, a length L of the wireless communication antenna 440 may range from 100 mm to 110 mm. In other words, the wireless communication antenna 440 is disposed between the first and second slits 411 and 412 inside the cover 410.

Hereinafter, referring to FIGS. 5A through 5C, the wireless communication antenna 440 will be described in more detail.

Figure 5A:
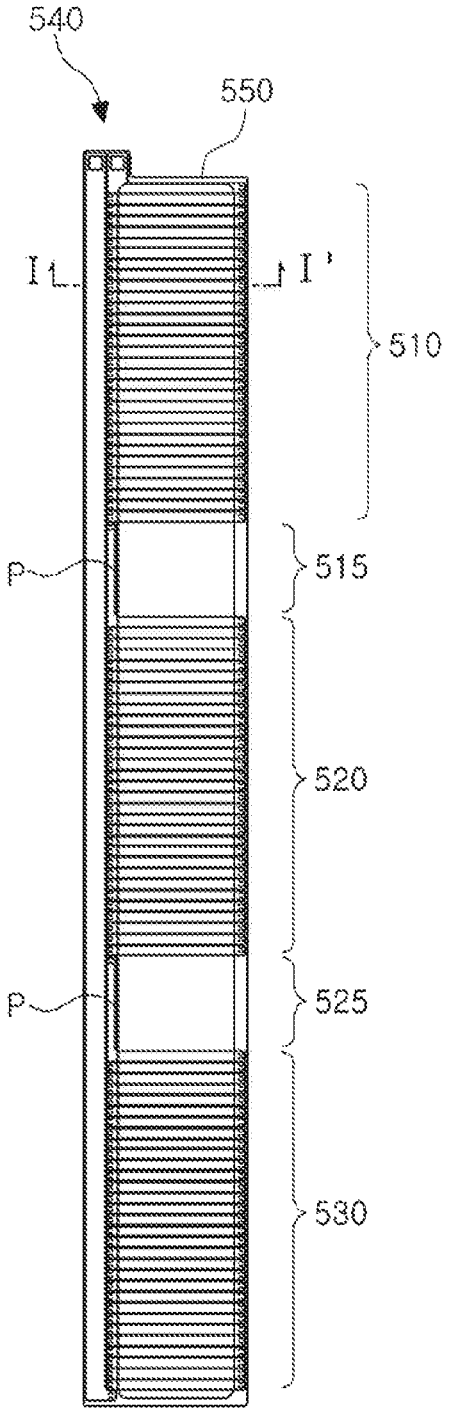
FIG. 5A is a front view of an example of a wireless communication antenna.

FIG. 5A is a front view of an example of a wireless communication antenna 540. FIG. 5B is a rear view of an example of the wireless communication antenna 540. FIG. 5C is a cross-sectional view taken along line I-I' of FIG. 5A.

Figure 5B:
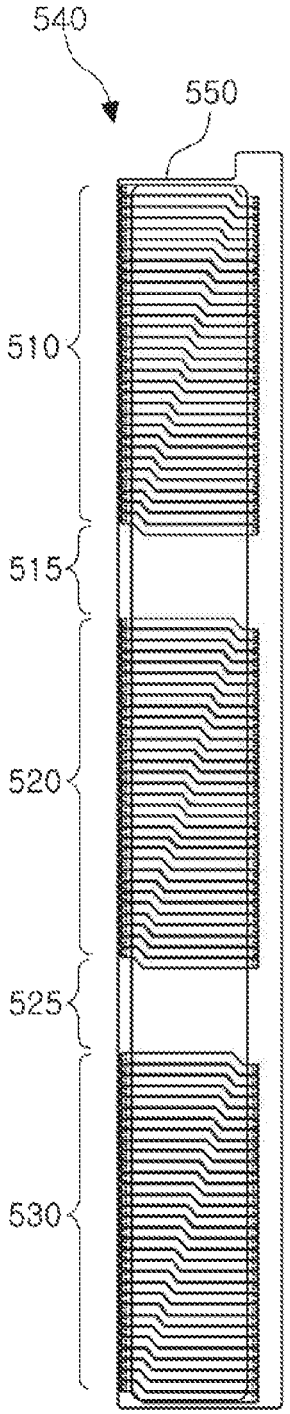
FIG. 5B is a rear view of an example of the wireless communication antenna.

Referring to FIGS. 5A and 5B, a wireless communication antenna 540 includes a plurality of coil portions and a magnetic body 550. The magnetic body 550 serves as the magnetic core for the wireless communication antenna 540. FIGS. 5A and 5B illustrate the wireless communication antenna 540 including three coil portions, such as first coil portion 510, the second coil portion 520 and the third coil portion 530, but the number of coil portions included in the wireless communication antenna 540 may be changed.

The first coil portion 510, the second coil portion 520 and the third coil portion 530 are spaced apart from each other with regions in which conductive patterns are not formed interposed therebetween.

For example, the first portion 510 and the second coil portion 520 include a first separation portion 515 therebetween, and the second coil portion 520 and the third coil portion 530 include a second separation portion 525 therebetween.

As illustrated in FIGS. 5A and 5B, the first coil portion 510, the second coil portion 520 and the third coil portion 530 include a plurality of conductive patterns. A conductive pattern configures a portion of one turn of each of the first coil portion 510, the second coil portion 520 and the third coil portion 530.

For example, one of the conductive patterns illustrated in FIG. 5A is connected to an opposing corresponding conductive pattern illustrated in FIG. 5B through a conductive via, and one loop of each of the first coil portion 510, the second coil portion 520 and the third coil portion 530 are completed as described by the above-mentioned connection.

The first coil portion 510 is connected in series to the second coil portion 520 by a pattern P, traversing the first separation portion 515, and the second coil portion 520 is connected in series to the third coil portion 530 by a pattern P, traversing the second separation portion 525.

When a driving signal is applied to the first coil portion 510, the second coil portion 520 and the third coil portion 530, the first coil portion 510, the second coil portion 520 and the third coil portion 530 will generate a plurality of magnetic field lines, respectively. A portion of the magnetic field lines is radiated through the regions between the first coil portion 510, the second coil portion 520 and the third coil portion 530. The wireless communication antenna 540 creates a magnetic field radiated through the opposing ends of the wireless communication antenna 540, the first separation portion 515, and the second separation portion 525, to create a magnetic field formed of a plurality of loops.

The first coil portion 510, the second coil portion 520 and the third coil portion 530 may have a different number of conductive patterns, and the arrangement of the first and second separation portions 515 and 525 may be correspondingly changed. For example, when a position of the first separation portion 515 is biased toward the first coil portion 510 of the wireless communication antenna 540, the number of conductive patterns included in the second coil portion 520 is greater than the number of conductive patterns included in the first coil portion 510.

Further, when the position of the first separation portion 515 is biased toward the second coil portion 520 of the wireless communication antenna 540, the width or arrangement interval of the conductive patterns included in the second coil portion 520 may be smaller than a width or an arrangement interval of the conductive patterns included in the first coil portion 510.

Hereinafter, the structure of the first coil portion 510 will be described in more detail with reference to FIG. 5C. Because the second and third coil portions 520 and 530 have the same structure as the first coil portion 510, repeated descriptions thereof will be omitted.

Figure 5C:
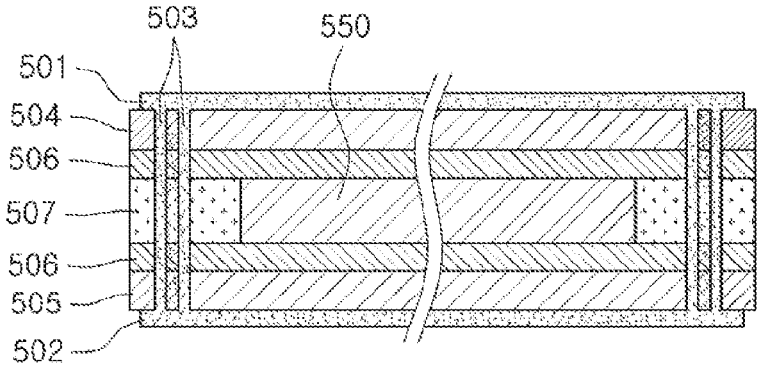
FIG. 5C is a cross-sectional view taken along line I-I' of FIG. 5A.

Referring to FIG. 5C, each of the first coil portion 510, the second coil portion 520 and the third coil portion 530 includes a first wiring portion 501, a second wiring portion 502, and a plurality of conductive vias 503. Further, each of the first coil portion 510, the second coil portion 520 and the third coil portion 530 includes a first substrate 504, a second substrate 505, and the magnetic body 550.

The first wiring portion 201 and the second wiring portion 502 are each formed of a conductive pattern. Further, the first wiring portion 501 is formed on the first substrate 504, the second wiring portion 502 is formed on the second substrate 505, and the magnetic body 550 is disposed between the first substrate 504 and the second substrate 505. In addition, the conductive vias 503 connect the conductive patterns of the first wiring portion 201 and the second wiring portion 502 to each other in a region around the magnetic body 550.

For example, in the wireless communication antenna 540, the first wiring portion 501 and the second wiring portion 502 are disposed around the magnetic body 550, which acts as a core, and connected to each other through the conductive vias 503 to define a solenoid.

The first substrate 504 and the second substrate 505, thin film substrates, may be, for example, a flexible board such as a flexible printed circuit board (FPCB). However, the first substrate 504 and the second substrate 505 are not limited thereto.

The magnetic body 550 is formed by stacking thin plate magnetic layers. The magnetic layer is formed of a soft magnetic alloy, and may be metal ribbons of a thin plate having an amorphous structure or a nanocrystal structure. Alternatively, the magnetic body 550 may be formed of permalloy, a high permeability material.

The magnetic body 550 is a core of the first coil portion 510, the second coil portion 520 and the third coil portion 530, prevents an eddy current, and reinforces a magnetic field created by the first coil portion 510, the second coil portion 520 and the third coil portion 530.

The first substrate 504 and/or the second substrate 505 is attached to the magnetic body 550 by an adhesive sheet 506. The adhesive sheet 506 may be formed of adhesive tape, and also may be formed by applying an adhesive or a resin having adhesive properties to a surface of the first or second substrate 504 or 505 or the magnetic body 550.

Since the first coil portion 510, the second coil portion 520 and the third coil portion 530 do not use a wire-type coil as in the related art, but use a coil pattern formed on a thin film substrate, the thickness of the thin film coil is significantly reduced.

The conductive vias 503 connect the first wiring portion 201 and the second wiring portion 502 around the magnetic body 550 to form a coil having a solenoid shape.

As illustrated in FIG. 5C, a conductive pattern on the first substrate 504 and a conductive pattern on the second substrate 505 are connected to each other by two conductive vias 503 to prevent a disconnection between the conductive patterns.

Further, the wireless communication antenna 540 includes a resin layer 507, and the resin layer 507 is formed of a thermosetting resin having insulating and adhesive properties.

The resin layer 507 is disposed between the first substrate 504 and the second substrate 505 on an external portion of the magnetic body 550. Since the resin layer 507 is disposed in a void around the magnetic body 550 between the first substrate 504 and the second substrate 505, the resin layer 507 prevents faults such as disconnections, bubble introduction, or the like, which may occur during a process. Further, the conductive vias 503 are formed through the resin layer 507.

In addition, although not illustrated in FIG. 5C, the wireless communication antenna 540 may include a cover layer. The cover layer is disposed on the first wiring portion 201 and the second wiring portion 502 to protect the first wiring portion 201 and the second wiring portion 502 on an outermost portion of the wireless communication antenna 540.

Figure 6:
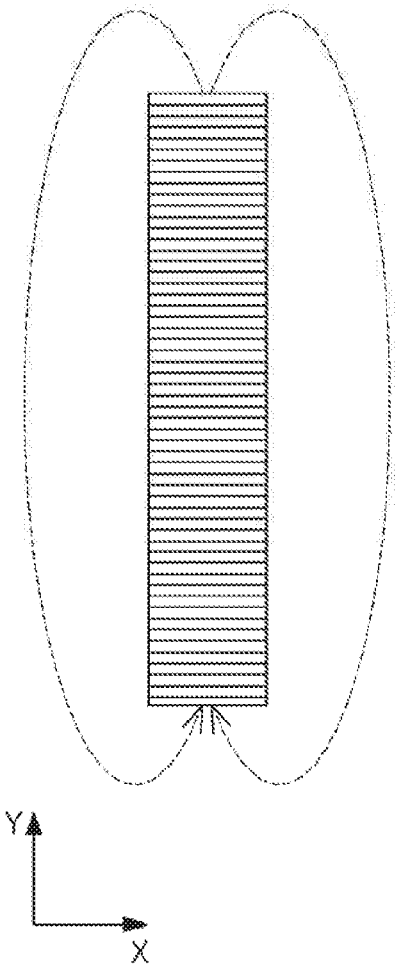
FIG. 6 is a view illustrating an example of radiation characteristics of a wireless communication antenna.
Figure 7:
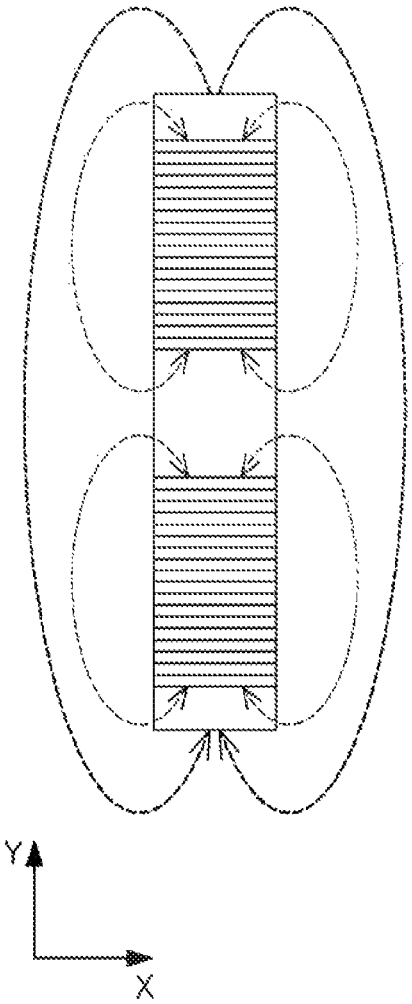
FIG. 7 is a view illustrating an example of radiation characteristics of another wireless communication antenna.
Figure 8:
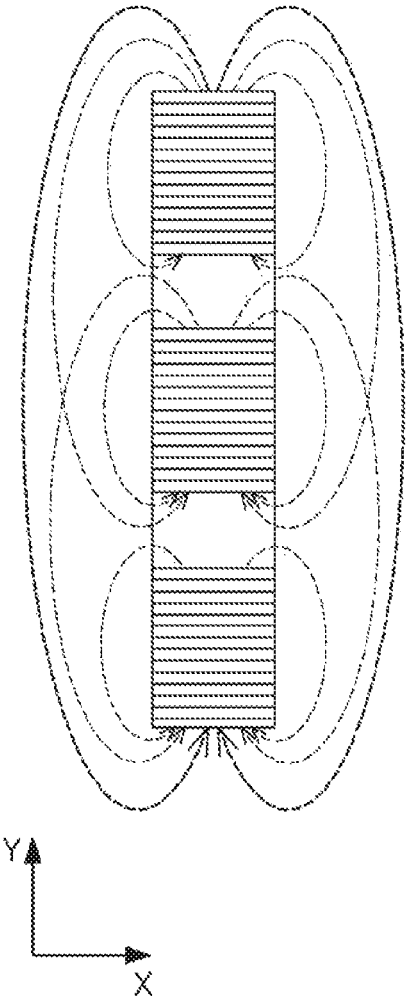
FIG. 8 is a view illustrating an example of radiation characteristics of another wireless communication antenna.

FIG. 6 is a view illustrating an example of radiation characteristics of a wireless communication antenna. FIG. 7 is a view illustrating an example of radiation characteristics of another wireless communication antenna. FIG. 8 is a view illustrating an example of radiation characteristics of another wireless communication antenna.

As a result of simulation of the wireless communication antenna, the magnetic field created by the wireless communication antenna is illustrated on the left side of FIGS. 6 through 8, and the table, listing recognition area measurements, is illustrated on the right side of FIGS. 6 through 8.

As illustrated in FIG. 6, the wireless communication antenna having no separation region generates a voltage Vhead lower than $V_{TH}$, which is a threshold value of the voltage Vhead (FIG. 2) detectable at a certain distance; thus, an undetectable area, for example, a null area, indicated by X in the table, appears. Such a null area makes it difficult to magnetically couple the wireless communication antenna to the wireless receiving device, and degrades reliability in wireless communications. Referring to the table of FIG. 6, the wireless communication antenna having no separation area exhibited a recognition rate of about 50.33%, based on 153 measurement points.

Referring to FIG. 7, the wireless communication antenna according to an example includes two coil portions spaced apart from each other.

As illustrated in FIG. 8, the wireless communication antenna according to an example includes three coil portions spaced apart from each other. Because the three coil portions are connected to each other in series, magnetic fields created by the three coil portions have the same directivity.

FIG. 7 is a view illustrating an example of radiation characteristics of another wireless communication antenna. The two coil portions are connected to each other in series, and thus magnetic fields created by the two coil portions have the same directivity.

Accordingly, the magnetic field radiated from a separation area between the two coil portions and magnetic fields radiated from opposing ends of the wireless communication antenna overlap each other. The overlap of these magnetic fields reduces the undetectable area, that is, the null area. Referring to the table of FIG. 7, the wireless communication antenna having the two coil portions exhibited a recognition rate of about 53.59%, based on the 153 measurement points.

FIG. 8 is a view illustrating an example of radiation characteristics of another wireless communication antenna. As illustrated in FIG. 8, the wireless communication antenna according to an example includes three coil portions spaced apart from each other. Because the three coil portions are connected to each other in series, magnetic fields created by the three coil portions have the same directivity.

Accordingly, magnetic fields radiated from separation areas among the three coil portions overlap one another. For example, when the three coil portions include a first coil portion, a second coil portion, and a third coil portion adjacent to each other, a magnetic field radiated from a region between the first and second coil portions may overlap a magnetic field radiated from a region between the second and third coil portions. Further, the magnetic fields radiated from the separation areas among the three coil portions overlaps magnetic fields radiated from opposing ends of the wireless communication antenna to be further strengthened.

Referring to the table of FIG. 8, the overlap of these magnetic fields significantly reduces the undetectable area, the null area. That is, the wireless communication antenna having the three coil portions exhibited a recognition rate of about 60.13%, based on the 153 measurement points.

The wireless communication antenna according to an example includes the three coil portions connected to each other in series, to thus strengthen magnetic flux and prevent an occurrence of the undetectable area. As a result, a detectable range of the magnetic field created by the wireless communication antenna may be extended.

As set forth above, according to the embodiments, a wireless communication antenna and a mobile device including the same may include a miniaturized and thinned solenoid coil, and may have improved radiation characteristics.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A wireless communication antenna, comprising:

a magnetic body;

coil portions having a solenoid shape and the magnetic body as a core, spaced apart from each other, and connected to each other in series, wherein magnetic fields, radiated by the coil portions, overlap each other, and each of the coil portions comprises:

a first wiring portion disposed on a first surface of the magnetic body;

a second wiring portion disposed on a second surface of the magnetic body; and conductive vias interconnecting the first wiring portion and the second wiring portion, wherein the wireless communication antenna, covered by a cover having at least one slit, is disposed such that a portion of the magnetic fields passes through the at least one slit, and wherein the at least one slit comprises a first slit and a second slit, and the wireless communication antenna is disposed on an internal portion of the cover between the first slit and the second slit.

2. The wireless communication antenna of claim 1, wherein the coil portions radiate the magnetic fields through a region between the coil portions, of the magnetic body.

3. The wireless communication antenna of claim 1, wherein the magnetic body is formed by stacking thin plate magnetic layers, and the magnetic layer is formed of a soft magnetic alloy material.

4. The wireless communication antenna of claim 1, wherein the first wiring portion and the second wiring portion comprise conductive patterns disposed on a thin film substrate, respectively.

5. The wireless communication antenna of claim 1, wherein the conductive vias are formed through a resin layer disposed on an external portion of the magnetic body.

6. The wireless communication antenna of claim 1, wherein the coil portions comprise three coil portions, and magnetic fields radiated from two regions between the three coil portions overlap each other.

7. The wireless communication antenna of claim 1, wherein the solenoid shape is formed around the magnetic body.

8. A mobile device, comprising:

a wireless communication antenna comprising coil portions each spaced apart from the other, the coil portions having a solenoid shape and a magnetic body as a core; and a cover having at least one slit and covering the wireless communication antenna, wherein the wireless communication antenna is disposed such that a portion of a magnetic field generated by the wireless communication antenna passes through the at least one slit, and wherein the at least one slit comprises a first slit and a second slit, and the wireless communication antenna is disposed on an internal portion of the cover between the first slit and the second slit.

9. The mobile device of claim 8, wherein the wireless communication antenna allows each of the coil portions to radiate magnetic field through a region between the coil portions of the magnetic body.

10. The mobile device of claim 8, wherein the magnetic body is formed by stacking thin plate magnetic layers and the magnetic layer is formed of a soft magnetic alloy material.

11. The mobile device of claim 8, wherein each of the coil portions comprises:

a first wiring portion disposed on a first surface of the magnetic body;

a second wiring portion disposed on a second surface of the magnetic body; and conductive vias interconnecting the first wiring portion and the second wiring portion.

12. The mobile device of claim 11, wherein the first wiring portion and the second wiring portion each comprise conductive patterns disposed on a thin film substrate.

13. The mobile device of claim 11, wherein the conductive vias are formed through a resin layer disposed on an external portion of the magnetic body.

14. The mobile device of claim 8, wherein the cover is formed of a metallic material, and the at least one slit is filled with a non-metallic material.

15. The mobile device of claim 8, wherein the wireless communication antenna radiates a magnetic pulse including magnetic stripe data.

16. The mobile device of claim 8, wherein the wireless communication antenna is disposed such that a wound shaft of the coil portions is perpendicular to the at least one slit.

17. A mobile device, comprising:

an antenna formed around a magnetic body, the antenna having coil portions each spaced apart and connected to the other;

each of the coil portions is formed on a film substrate; and a metallic cover disposed over the antenna, the metallic cover having slits, wherein each of the coil portions of the antenna radiate magnetic fields and the magnetic fields of each of the coil portions overlap to radiate magnetic stripe data, wherein the antenna is disposed such that a portion of the magnetic fields passes through the slits, and wherein the slits comprises a first slit and a second slit, and the antenna is disposed on an internal portion of the metallic cover between the first slit and the second slit.

18. The mobile device of claim 17, wherein the magnetic fields radiate through the slits.

19. The mobile device of claim 18, wherein each of the coil portions is connected through conductive vias.

20. The mobile device of claim 19, wherein the conductive vias are formed through a resin layer disposed on an external portion of the magnetic body.

21. A wireless communication antenna, comprising:

a magnetic body;

coil portions having a solenoid shape and the magnetic body as a core, spaced apart from each other, and connected to each other in series, wherein magnetic fields, radiated by the coil portions, overlap each other, and each of the coil portions comprises:

a first wiring portion disposed on a first surface of the magnetic body;

a second wiring portion disposed on a second surface of the magnetic body; and conductive vias interconnecting the first wiring portion and the second wiring portion, wherein the wireless communication antenna, covered by a cover having at least one slit, is disposed such that a portion of the magnetic fields passes through the at least one slit, and wherein the wireless communication antenna is disposed such that a wound shaft of the coil portions is perpendicular to the at least one slit.

22. A mobile device, comprising:

an antenna formed around a magnetic body, the antenna having coil portions each spaced apart and connected to the other;

each of the coil portions is formed on a film substrate; and a metallic cover disposed over the antenna, the metallic cover having slits, wherein each of the coil portions of the antenna radiate magnetic fields and the magnetic fields of each of the coil portions overlap to radiate magnetic stripe data, and wherein the antenna is disposed such that a wound shaft of each of the coil portions is perpendicular to the slits.

* * * * *